US006499895B1

(12) United States Patent
Duesterhus et al.

(10) Patent No.: US 6,499,895 B1
(45) Date of Patent: Dec. 31, 2002

(54) PRINTER WITH CONTROL CAM SHAFT

(75) Inventors: Richard Duesterhus, Paderborn (DE); Paul Freitag, Steinheim (DE); Reimund Selke, Paderborn (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/786,573

(22) PCT Filed: Aug. 6, 1999

(86) PCT No.: PCT/DE99/02469

§ 371 (c)(1),
(2), (4) Date: Mar. 7, 2001

(87) PCT Pub. No.: WO00/13909

PCT Pub. Date: Mar. 16, 2000

(30) Foreign Application Priority Data

Sep. 8, 1998 (DE) ..... 198 40 997

(51) Int. Cl.[7] ..... B41J 13/28
(52) U.S. Cl. ..... 400/631; 400/630; 400/632
(58) Field of Search ..... 400/656, 657, 400/24, 25, 27, 28, 631, 632, 632.2, 636, 632.1

(56) References Cited

U.S. PATENT DOCUMENTS

| | | | | | |
|---|---|---|---|---|---|
| 4,232,217 | A | * | 11/1980 | Juziuk et al. | 101/233 |
| 4,237,466 | A | * | 12/1980 | Scranton | 101/389.1 |
| 5,139,353 | A | * | 8/1992 | Ota | 400/584 |
| 5,277,507 | A | * | 1/1994 | Garcia-Cano et al. | 271/236 |
| 6,092,949 | A | * | 7/2000 | Koyabu et al. | 400/642 |

FOREIGN PATENT DOCUMENTS

| | | |
|---|---|---|
| DE | 2 243 922 | 4/1974 |
| DE | 2424144 | 11/1975 |
| DE | 25 34 439 | 4/1976 |
| DE | 31 44 388 | 5/1983 |
| WO | WO96/01742 | 1/1996 |

* cited by examiner

*Primary Examiner*—Daniel J. Colilla
(74) *Attorney, Agent, or Firm*—McCormick, Paulding & Huber LLP

(57) ABSTRACT

In a printer for printing on individual printing media such as receipts, savings books and the like, a control shaft activated by the printer control system has a plurality of control cams for activation of a transport device, a printing medium alignment means, and a printing medium stop, the cams being designed such that the activation zone of the alignment means and of the printing medium stop are located substantially in the deactivation zone of the transport device.

8 Claims, 12 Drawing Sheets

PRINTER WITH CONTROL CAM SHAFT

Figure 1:
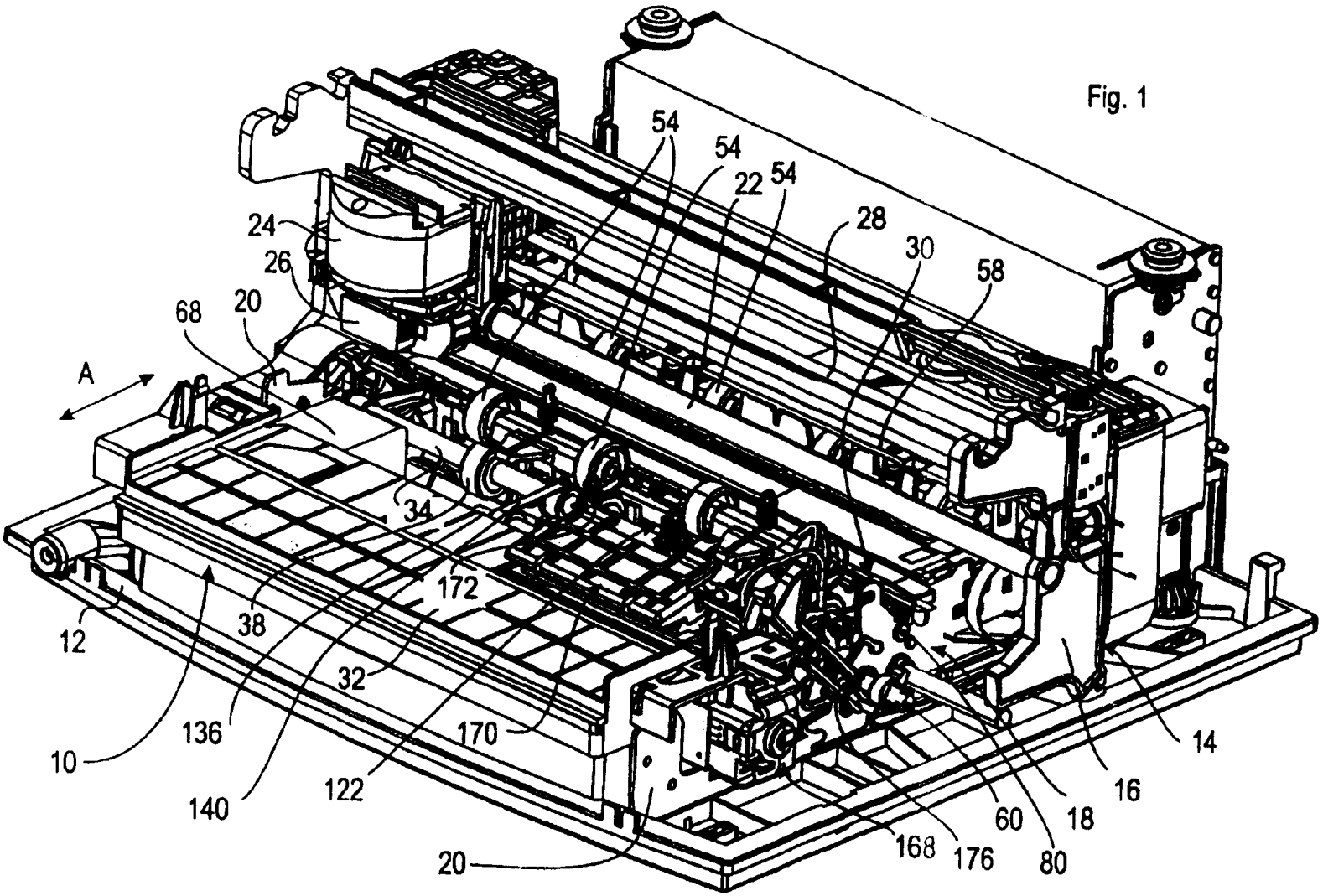

The invention relates to a printer for printing on individual printing media according to the preamble of claim 1. It is based on WO-A-96/01742.

A printer of the type mentioned is marketed under the designation "HighPrint 4905" by Siemens Nixdorf Informationssysteme AG, Paderborn, Germany.

In such a printer, various functions for handling and processing the individual printing medium have to be controlled. Although these functions proceed in a specific sequence, they do not have to be activated in the case of all individual printing media. For example, when processing savings books, functions are activated which are not needed when printing on receipts.

In WO-A-96/01742, it has already been proposed to mount a control shaft such that it can rotate in a printer frame, said shaft being capable of being driven by a motor that can be activated by a printer control system and bearing a control curve which controls at least the activation of the transport device, the activation of the alignment means and the adjustment of the printing-medium stop.

The invention is based on the object of designing a printer of the type mentioned at the beginning in such a way that the individual units for handling a printing medium in the printer can also be operated reliably and in a straightforward manner without hampering one another.

According to the invention, in a printer of the type mentioned at the beginning this object is achieved by the features specified in the characterizing part of claim 1.

Using the control shaft provided in accordance with the invention, it is possible to ensure in a straightforward way that a printing medium inserted into the printer is firstly aligned against the printing-medium stop and brought into a starting position which is suitable for the printing operation, before the transport device is set into operation. By means of the arrangement of the control cams on the control shaft relative to one another, the desired trouble-free progress of the functions is ensured.

The transport device can be controlled in a straightforward way by its comprising at least one driven transport shaft bearing transport rollers and pressure rollers which are associated with the transport rollers and can be adjusted between a pressure or activation position close to the transport rollers and a rest or deactivation position away from the transport rollers. In this case, the motor driving the transport shaft does not need to be switched, so that a control system for controlling the starting and braking of the motor can be dispensed with.

According to a further function, provision is made for the printing bar to be adjustable in relation to the printing head by a control cam on the control shaft between a printing position close to said printing head and a rest position away from the latter, and by the controlled curve of the printing-bar control cam being designed such that the rest position of the printing bar is located in the activation zone of the transport device. On the other hand, that angular range of the control curve of the printing-bar control cam which corresponds to the printing position of the printing bar extends over the deactivation zone and preferably an adjacent part of the activation zone of the transport device.

In order to press the printing medium against the printing bar and therefore to permit clean printing, there is arranged parallel to the printing bar a protective film strip on a film carrier, which can be adjusted between a position close to the printing bar and a position away from the printing bar. According to the invention, in this case the adjustment of the film carrier can be controlled by a film carrier control cam on the control shaft, whose control curve is designed such that there is correspondence between the printing position of the printing bar and the position of the film carrier close to the printing bar, on the one hand, and the rest position of the printing bar and the position of the film carrier away from the printing bar, on the other hand. In the rest position of the printing bar, the receipt can therefore be transported into the printer without hindrance while it is pressed against the printing bar by the film strip in the printing position of the printing bar, and is therefore held in a position ensuring clean printing.

In the case of specific printing media, it is necessary to obtain information about the type of printing medium before the printing operation. For this purpose, the printer has a reading device which, for example, is designed for reading characters produced on the printing medium with magnetic ink, and has at least one magnetic head and a first printing-medium pressure device which, according to the invention, can be activated by a control cam on the control shaft, the control curve of this control cam being designed such that the activation zone of the first printing-medium pressure device is located in the zone corresponding to the rest position of the printing bar.

Furthermore, in the printer there can be provided a reading/writing device for reading and writing on a magnetic strip on a printing medium, which has a magnetic head arrangement and a second printing-medium pressure device. According to the invention, this can likewise be activated by a control cam on the control shaft, the control curve of this control cam being designed such that the activation zone of the second printing-medium pressure device is located within the activation zone of the first printing-medium pressure device.

It is expedient for the start position and end position of the control shaft, between which the latter can be rotated to and fro, to be defined by a switching flag arranged on the control shaft.

Figure 2:
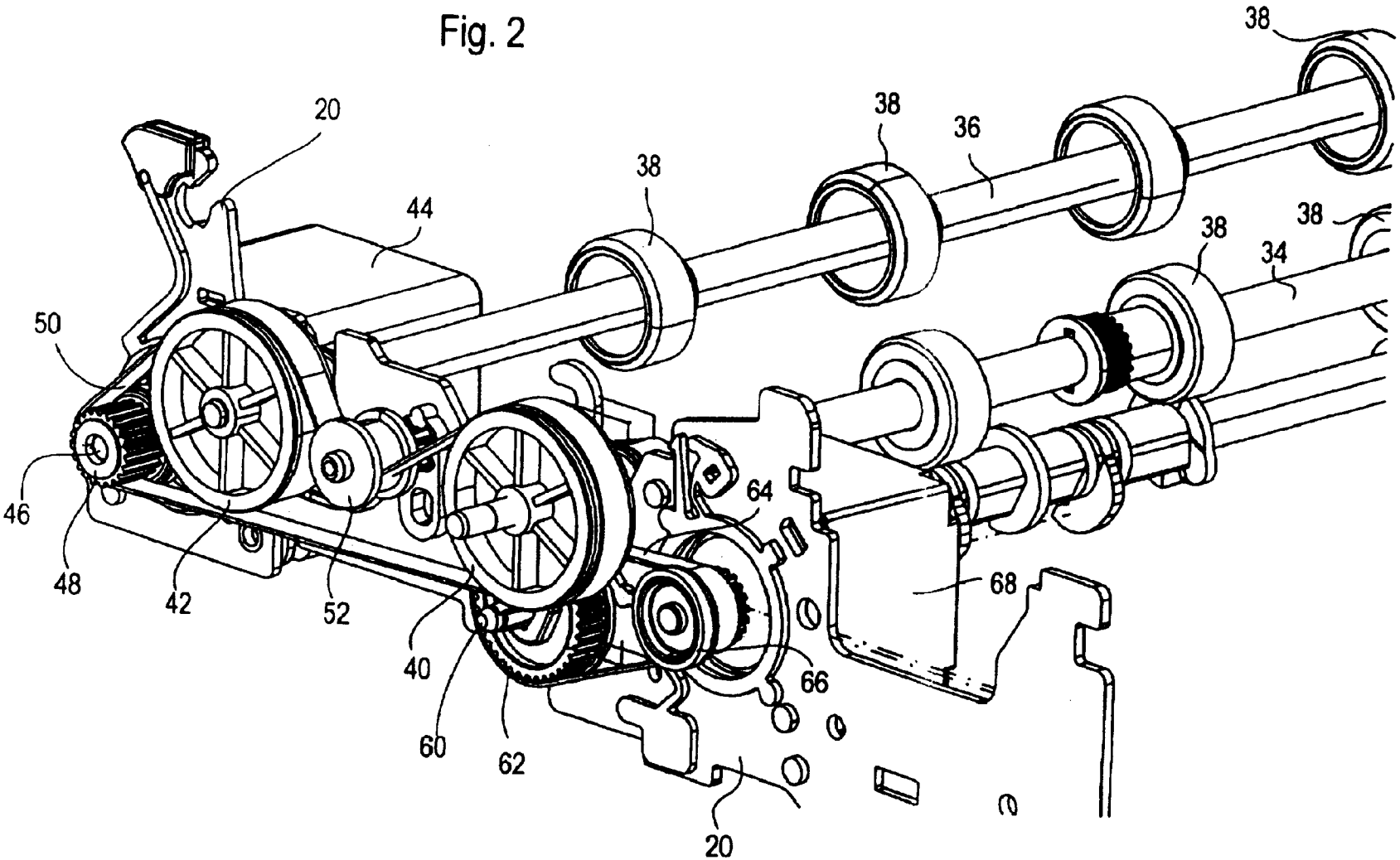
Figure 3:
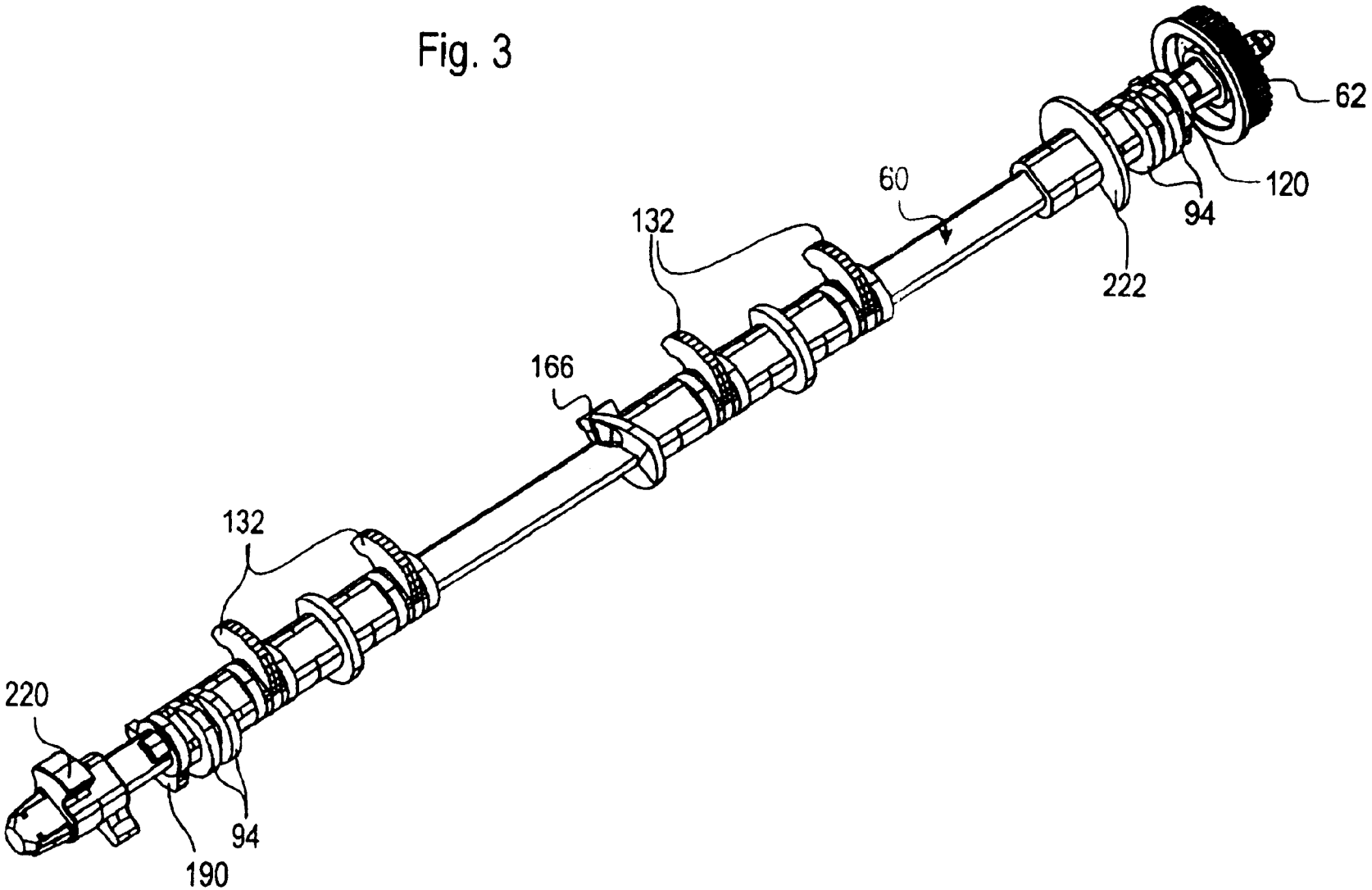
Figure 4:
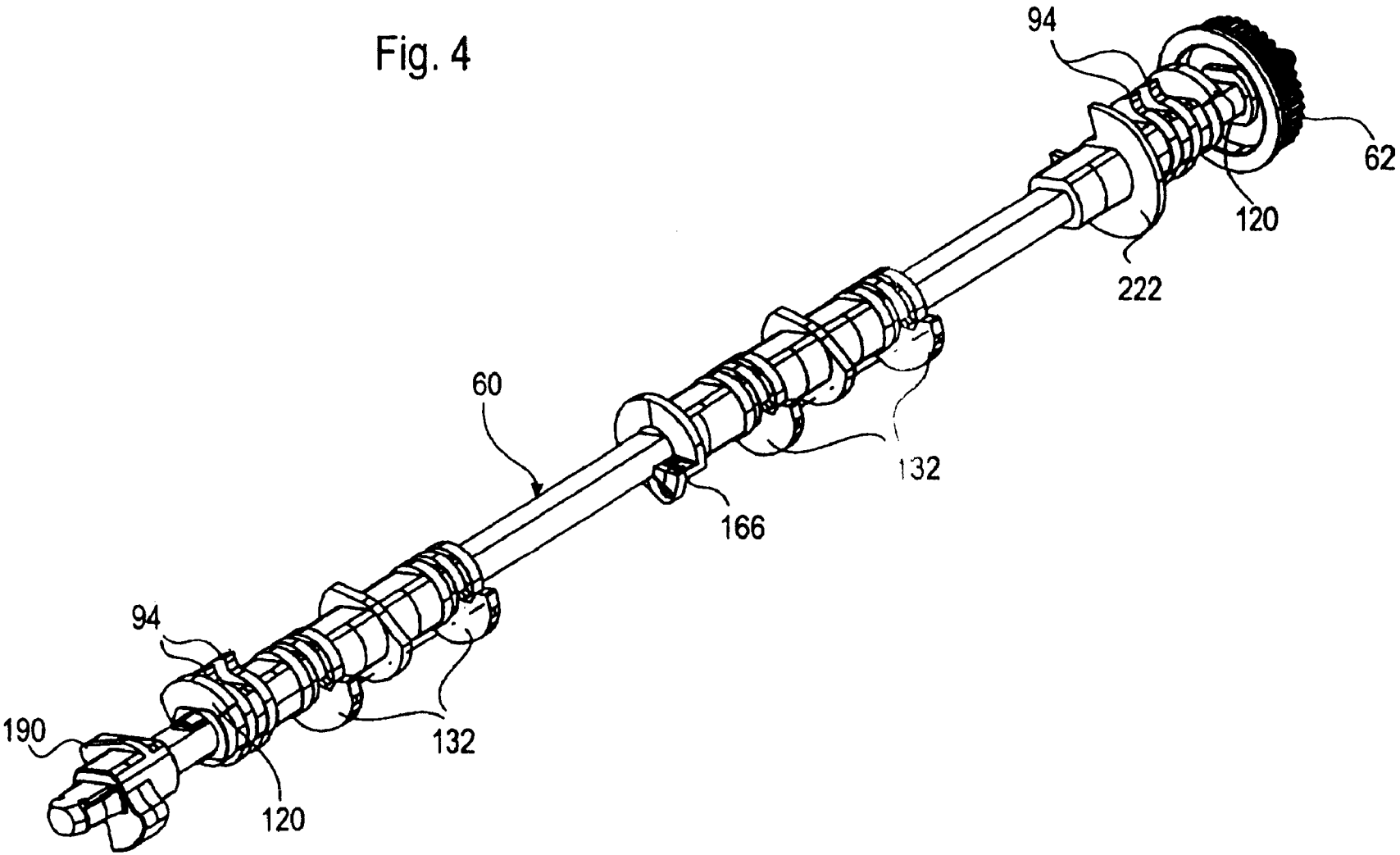
Figure 5:
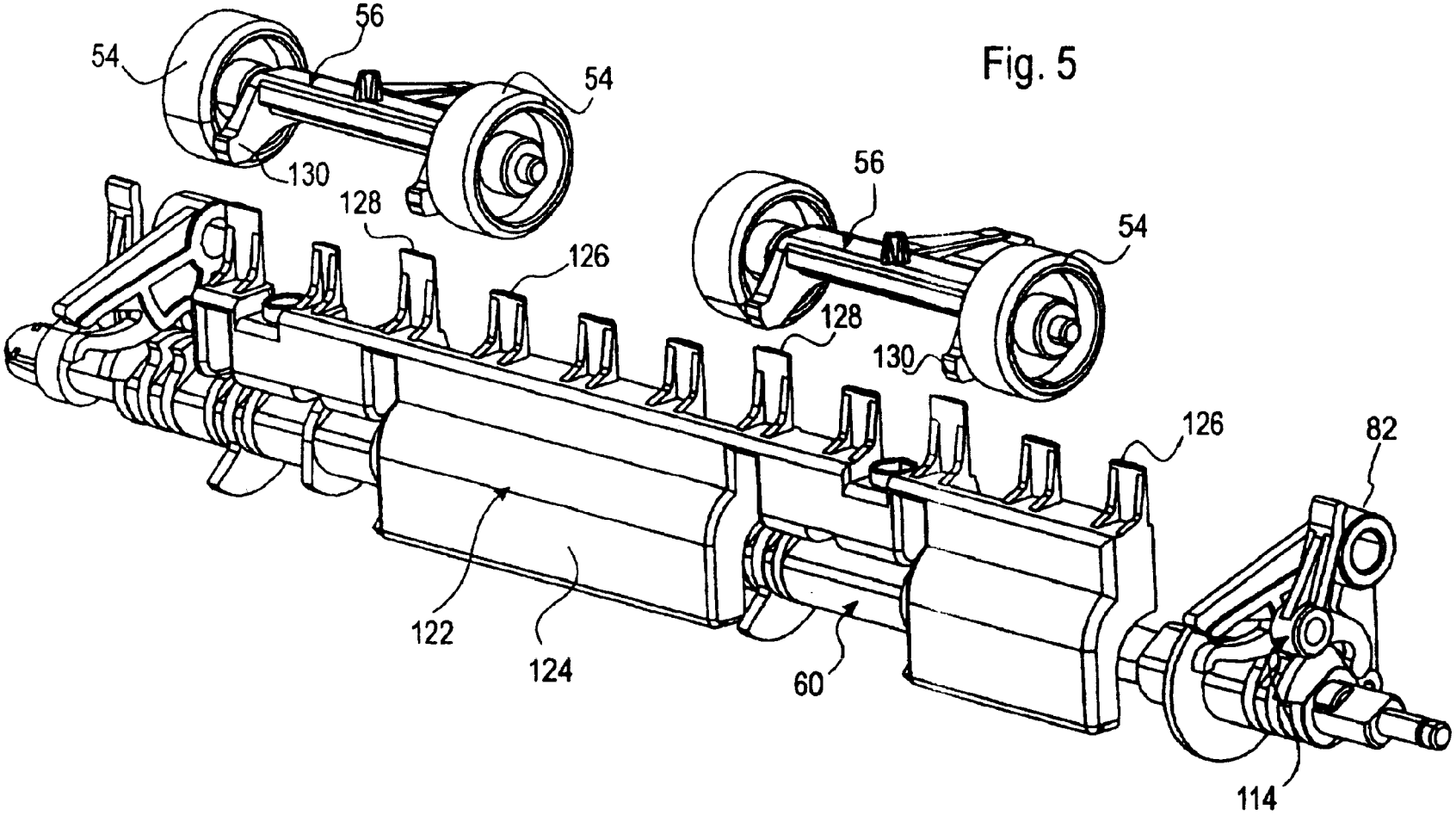
Figure 6:
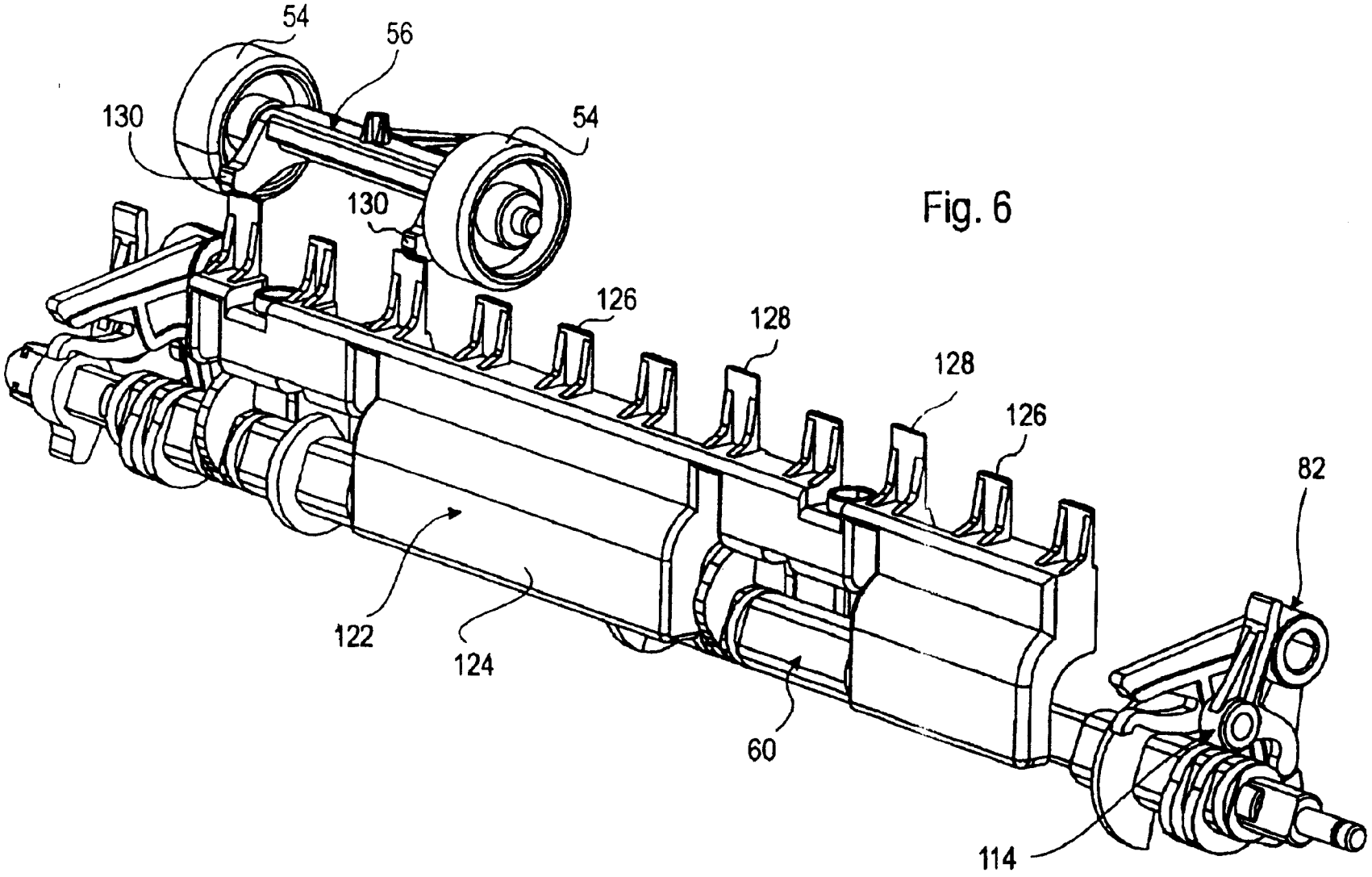
Figure 7:
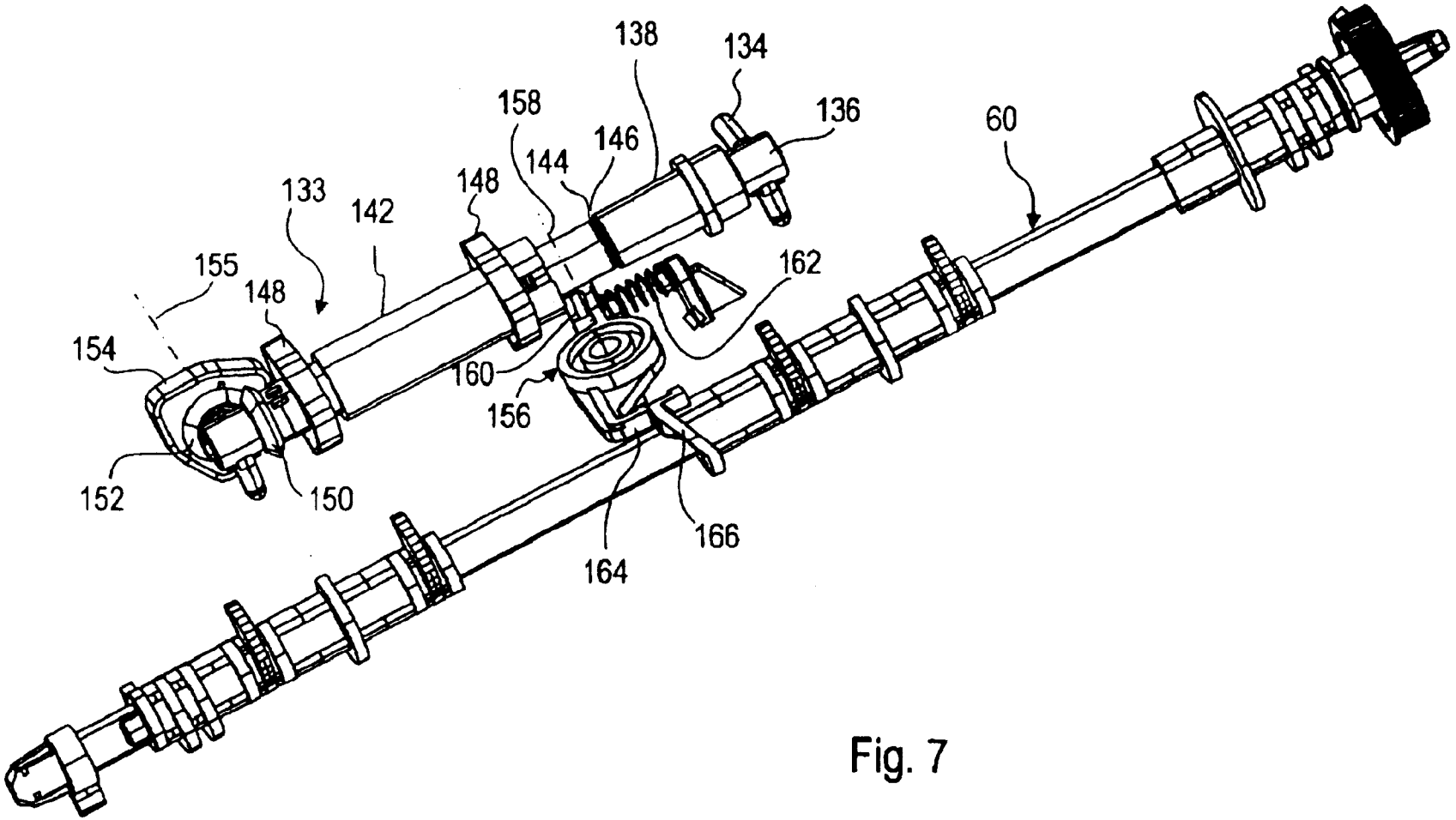
Figure 8:
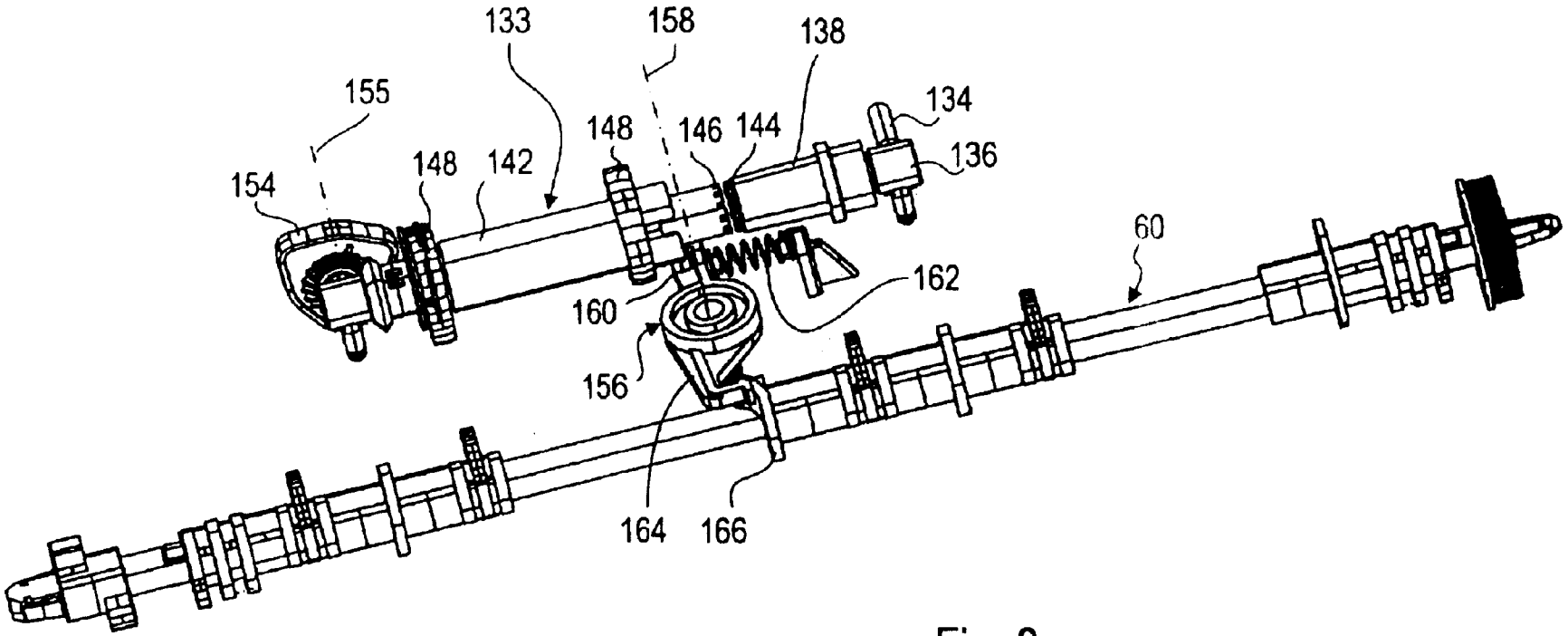
Figure 9:
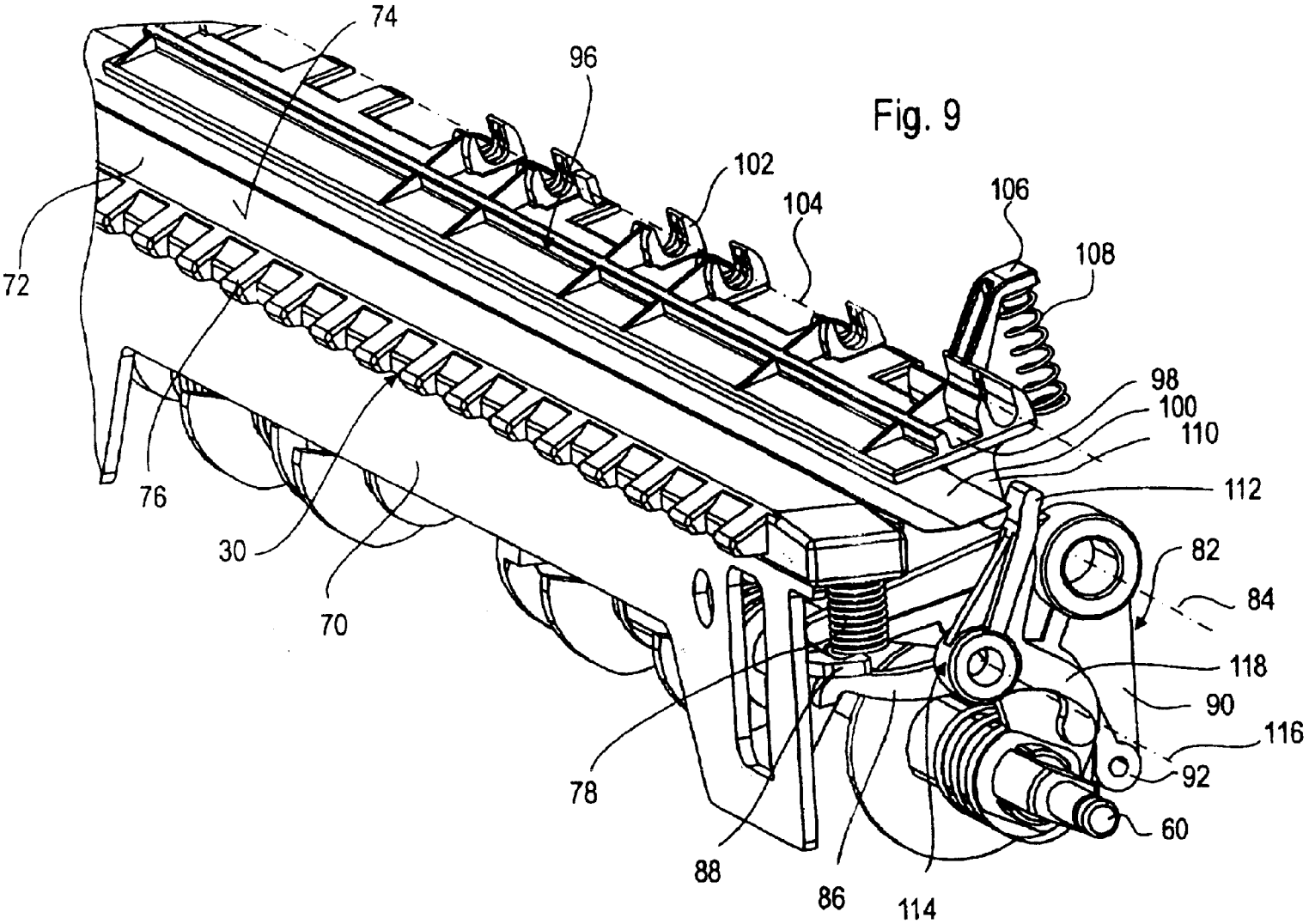
Figure 10:
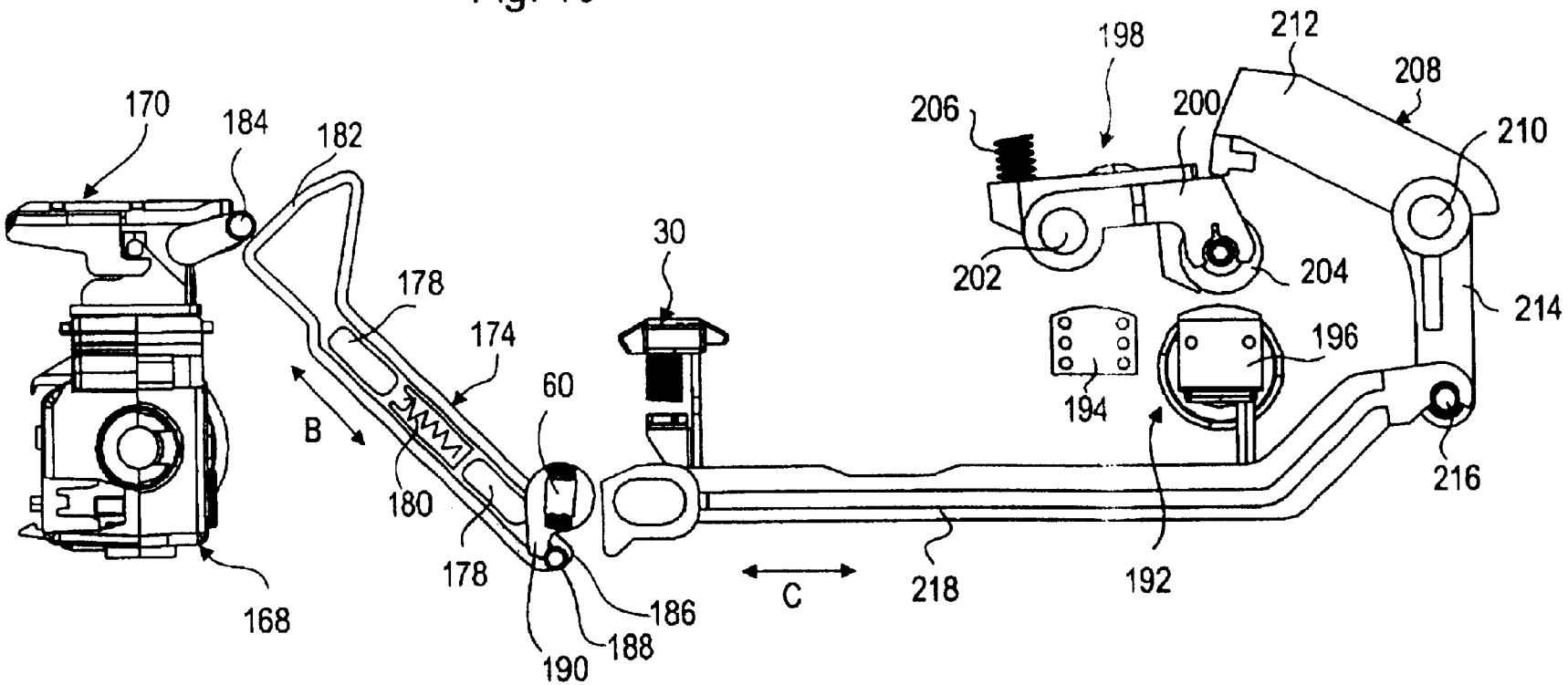
Figure 11:
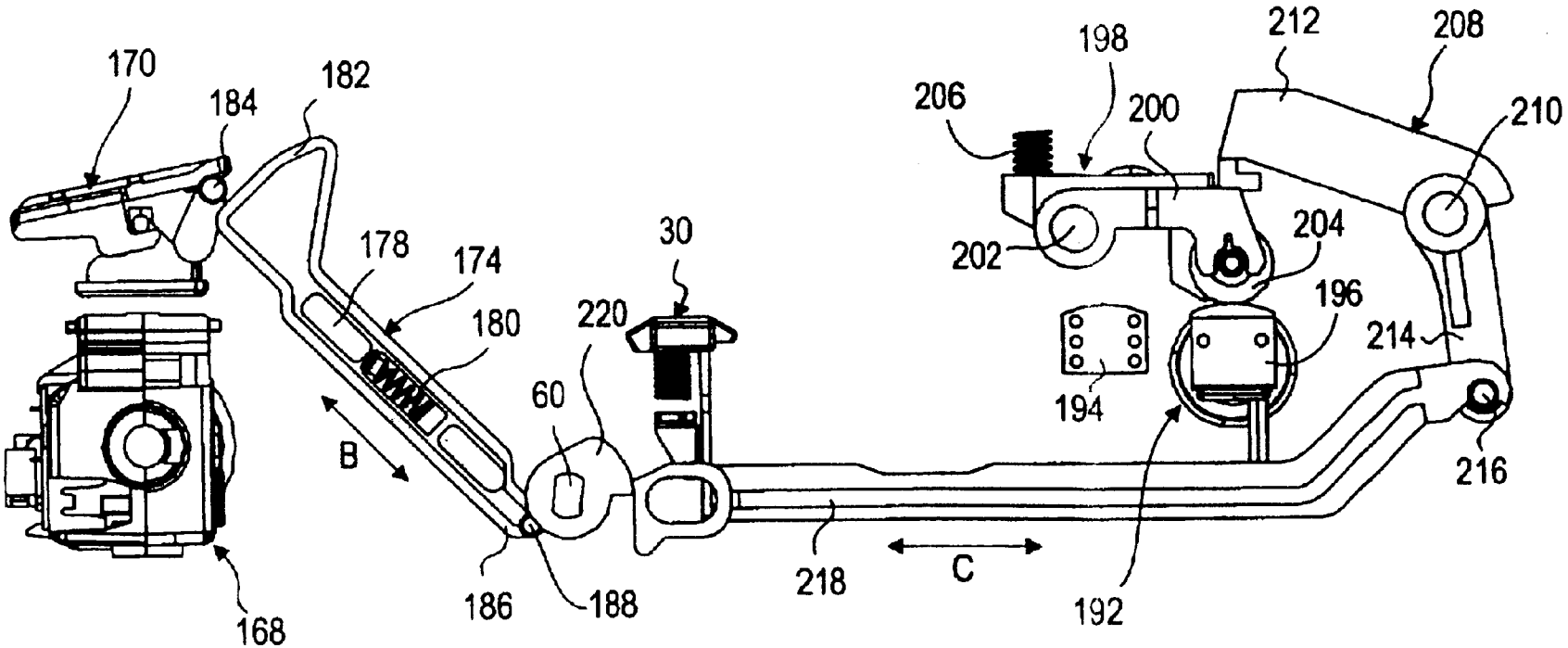
Figure 12:
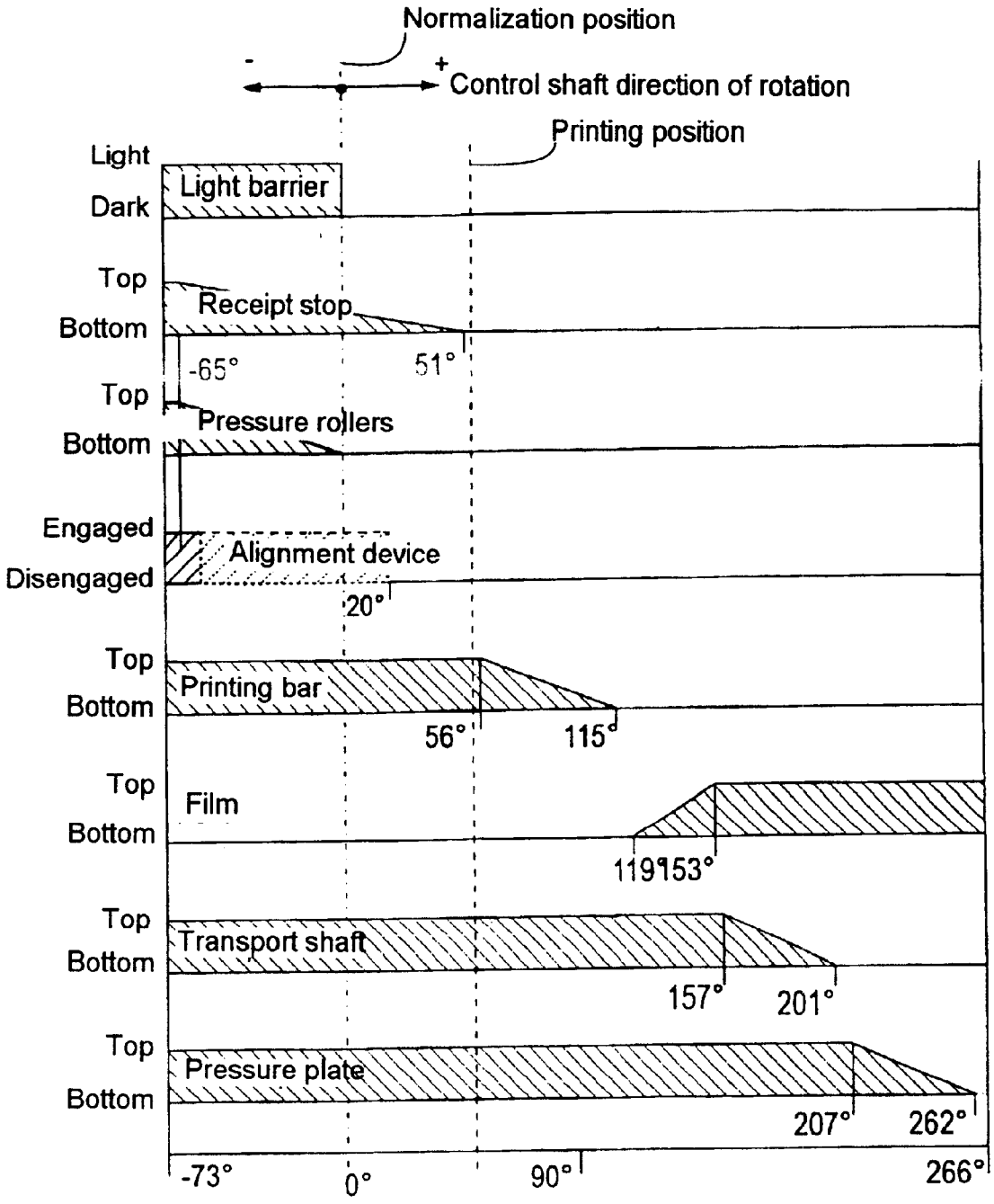

Further features and advantages of the invention emerge from the following description, which explains the invention using an exemplary embodiment in conjunction with the appended drawings, in which:

FIG. 1 shows a perspective overall view of a printer according to the invention without the upper part of the printer housing, FIG. 2 shows a perspective partial view of a side wall of the printer chassis with the drive for the transport shafts and the control shaft, FIG. 3 shows a perspective view of the control shaft in a first angular position, FIG. 4 shows a perspective view of the control shaft in a second angular position, FIG. 5 shows a perspective illustration of the control shaft, the receipt stop and the pressure rollers in a first position of these elements, FIG. 6 shows an illustration corresponding to FIG. 5 in a second position of the said elements, FIG. 7 shows a perspective illustration of the control shaft and of the alignment mechanism in an activated position of the latter, FIG. 8 shows an illustration corresponding to FIG. 7 of the alignment mechanism in its deactivated position, FIG. 9 shows a perspective view of the printing bar and of the film carrier, FIG. 10 shows a schematic side view of a magnetic-strip reading arrangement and a reading arrangement for reading characters produced on the printing medium with magnetic ink, in a first position of these elements, FIG. 11 shows an illustration corresponding to FIG. 10 with the elements in a second position, and FIG. 12 shows a timing diagram of the functional sequences of the printer units as a function of rotational angle and direction of rotation of the control shaft.

The printer illustrated in FIG. 1 is used for printing individual printing media such as receipts, savings books and the like. It comprises a chassis designated generally by 10 and having a base 12, an outer frame 14 with frame walls 16 and an inner frame 18 with side walls 20.

Between the side walls 16 of the outer frame 14 there extends a guide rod 22, on which a carriage 26 bearing a dot-matrix printing head 24 is guided such that it can be displaced to and fro. The carriage is driven via a toothed belt 28.

The dot-matrix printing head 24 is arranged in such a way that its needles are displaced substantially vertically and the tips of the needles are oriented downward. The printing head 24 is assigned, as a printing abutment, a printing bar 30 which extends between the two side walls 20 of the inner frame 18, parallel to the guide rod 22. The design and arrangement of the printing bar 30 will be explained in more detail further below.

The printing media are moved between a lower cover 32, which has been partially removed in FIG. 1; and an upper covering (not illustrated) formed on a housing hood. The movement is carried out with the aid of a transport device, which can be seen better in FIG. 2. It comprises two transport shafts 34, 36 which are aligned parallel to the guide rod 22, which are at a distance from each other in the transport direction of the printing medium indicated by the double arrow A in FIG. 1, and each bear transport rollers 38 spaced apart axially. The transport shafts 34 and 36 are rotatably mounted in the side walls 20 of the inner frame 18 and, at their one end projecting beyond the side wall 20, each bear a drive roller 40 and 42, respectively. In addition, a drive motor 44, whose shaft 46 bears a drive pinion 48, is flange-mounted on the side wall 20 of the inner frame. Said drive pinion drives the transport shafts 34 and 36 via a drive belt 50, which is led over the drive rollers 42 and 40 and a tensioning roller 52.

The transport rollers 38 are additionally each assigned pressure rollers 54, which are mounted above the transport rollers 38,in each case in pairs, on a carrier 56. The rear pressure rollers 54 associated with the rear transport shaft 36 are mounted, with their respective carrier 56, on a transverse strut 58 such that their height can be adjusted. The carriers 56 of the front pressure rollers 54 are mounted on the upper covering (not illustrated) such that their height can be adjusted so that they can be lifted off the transport rollers 38 or set down onto the latter, as will be explained in more detail further below.

Also mounted in the side walls 20 of the inner frame 18 is a control shaft 60 which is oriented parallel to the transport shafts 34 and 36 and which, at its one end, bears a gear wheel 62 (FIGS. 2 and 3), via which it can be driven by a toothed belt 64, which also runs over a drive pinion 66 of a motor 68. As FIG. 3 shows, the control shaft 60 bears a large number of cams for controlling mechanical functions in the printer, as will be further discussed in detail below.

FIG. 9 shows the printing bar 30 in greater detail. It comprises a flat, rule-like carrier 70, which is stamped from a metal sheet, for example, and a top rail 72, which consists of plastic and is connected to the carrier 70 along a longitudinal edge of the latter. The top rail has a flat top side 74, which serves as a rest for the printing medium, and on both long sides, guide noses 76 which fall away downwards and are intended to ensure that the printing medium is guided onto the surface 74 of the printing bar 30 as it is transported into the printer.

The printing bar 30 is mounted between the side walls 20 of the inner frame 18 such that it can be adjusted vertically, and is biased into an upper position by a helical compression spring 78 at its long ends in each case. The helical compression spring 78 is supported on a pin element 80 which is fixed to the frame and is fastened to the outside of the respective side wall 20 (FIG. 1). Associated with the printing bar 30, at each of its long ends, is an actuating lever 82, which is mounted such that it can be pivoted about a pivot axis 84 on the respective side wall 20. The actuating lever 82 has a fork-like lever arm 86 which, between the limbs of the fork, holds a lug 88 projecting from the carrier 70 of the printing bar 30. A second lever arm 90, projecting approximately at right angles in relation to the fork arm 86, in each case rests with its free end 92 on two cam discs 94, which are provided close to the long ends of the control shaft (FIG. 3). With the aid of the actuating lever 82, the printing bar 30 can be adjusted downwards, counter to the bias of the helical compression springs 78, by the cam discs 94 on the control shaft 60.

Provided parallel to the printing bar 30 is a pressure device 96, which is used to press the respective printing medium against the surface 74 of the printing bar 30, and therefore to ensure a predefined distance between the printing-medium surface and the printing head 24. The pressure device comprises a film carrier 98 and a film strip 100 fixed to the latter (FIG. 9). The film carrier 98 can be clipped in on a rod on the upper covering (not illustrated) with the aid of clips 102, so that it can be pivoted about the axis 104 of this rod. At its respective long end, the foil carrier 98 has a lever 106, on which a helical compression spring 108 acts, which is supported by its other end on a part fixed to the frame and biases the film carrier 98 in the counter-clockwise direction in FIG. 9, against the upper side 74 of the printing bar 30. In addition, the film carrier 98 has, at each of its long ends, an extension 110 which projects downward and on which a first lever arm 112 of an actuating lever designated generally by 114 rests. This actuating lever 114 is mounted such that it can rotate about an axis 116 on the respective side wall 20 of the frame 18 and has a second lever arm 118, which is intended to rest on a cam disc 120 of the control shaft 60. Therefore, in the event of rotation of the control shaft 60, the pressure device 96 can be rotated in the clockwise direction in FIG. 9 counter to the bias of the springs 108, and therefore lifted off the printing bar 30.

FIGS. 5 and 6 show a receipt stop, generally designated by 122, and also the front pressure rollers in two different positions. The receipt stop comprises an elongate carrier 124, which engages over the control shaft 60 and bears a row of stop elements 126, 128 on its upper edge. If the receipt stop 122 is in its lower position illustrated in FIG. 5, a receipt can be pushed into the printer onto the printing bar 30. In this position, the roller carriers 56 are lowered, so that the pressure rollers 54 rest on the transport rollers 38. If the receipt stop 122 is in the upper position, illustrated in FIG. 6, then the stop elements 126 and 128 block the path of the printing media and prevent the latter being pushed onto the printing bar 30. In this position, the longer stop elements 128 which can be seen in FIGS. 5 and 6 in each case press against extensions 130 on the roller carriers 56 and lift the latter, so that the pressure rollers 54 no longer have any contact with the transport rollers 38. The adjustment of the receipt stop 122 is provided by cam discs 132, on which the carrier 124 of the receipt stop 122 rests.

The printer further comprises an alignment device, designated generally by 133, in order to align the printing medium against the receipt stop. This alignment device 133 is illustrated in FIGS. 7 and 8. It comprises a shaft 136 which is mounted on the chassis base 12 in bearing blocks 134 and on which a first coupling sleeve 138 is rotatably mounted, the latter being capable of being driven by the front transport shaft 34 via a drive belt 140 (FIG. 1). In addition, a second coupling sleeve 142 is mounted on the shaft 136 such that it can be rotated and displaced axially; said sleeve can be engaged with the first coupling sleeve 138 so as to transmit torque via coupling claws 144 with corresponding coupling claws 146 on the first coupling sleeve 138. Fixed to the second coupling sleeve 142 are approximately triangular alignment rollers 148, which can reach through openings which are formed in the lower covering 32, in order to engage with a printing medium lying on the lower covering 32. In addition, at its end facing away from the first coupling sleeve 138, the second coupling sleeve 142 bears a bevel gear wheel 150, which interacts with a bevel gear wheel 152 aligned at right angles to it in order to drive a further alignment roller 154, whose shaft 155 is oriented at right angles to the shaft 136.

The triangular shape of the rollers 148 and 154 has the effect that the printing medium lying on the lower covering 32 is lifted up abruptly and, on the one hand is transported in the direction of the stop elements 126, 128, but on the other hand is transported by the roller 154 in the direction of one of the side walls 20 of the frame 18. As a result, relative to the receipt stop 122, the printing medium is brought into a defined starting position for a printing operation.

The alignment device can be switched on and off by the coupling engagement between the two coupling sleeves 138, 142 being made or broken as desired. For this purpose, use is made of a coupling lever 156, which is mounted on the chassis base (in a manner not illustrated) such that it can be rotated about a shaft 158 substantially perpendicular to the chassis base 12. A first lever arm 160 of the coupling lever 156 rests with its free end on the second coupling sleeve 142 and is biased by a helical spring 162 with the effect of disengaging the coupling engagement between the two coupling sleeves 138, 142. At the same time, as a result, a second lever arm 164 of the coupling lever 156 is urged against an axial cam disc 166 on the control shaft 60. If, as a result of a rotation of the control shaft 60, the coupling lever 156 is pivoted in the counterclockwise direction out of the position illustrated in FIG. 7 into the position illustrated in FIG. 8, the result is that the coupling engagement between the two coupling sleeves 138 and 142 is released, and therefore the drive to the alignment rollers 148, 154 is interrupted.

Printing media such as savings books or the like generally bear a magnetic strip on which specific information about the holding of the savings book, account number, account balance and the like are stored. In order to read and write on this magnetic strip, use is made of a reading/writing device generally designated by 168, which is arranged under the lower covering 32 in such a way that the magnetic gap in the magnetic head lies in the surface of the lower covering 32 and can be displaced in the printer transversely with respect to the insertion direction of the printing medium. Such a reading/writing device is known per se and therefore does not need to be explained in detail. The reading/writing device 168 is assigned a pressure device 170 in order to press the printing medium against the magnetic head of the reading/writing device 168. The reading/writing device 168 and the pressure device 170 associated with it are illustrated in FIGS. 10 and 11.

The pressure device 170 is arranged on the upper covering of the printer in a manner not specifically illustrated and is biased in the direction of the lower covering 32 by compression springs 172 (FIG. 1). FIG. 11 shows the pressure device 170 in its upper position. In this position, it is held by an actuating lever 174, which is guided displaceably on one side wall 20 of the frame 18, in the direction of the double arrow B in FIG. 11, with the aid of pins 176 which engage in slots 178 in the actuating lever 174. The actuating lever 174 is biased obliquely upward in FIG. 11 by a compression spring 180, which is supported at one end by an actuating lever 174 and at the other end on a part fixed to the frame, the top end 182 of said lever striking a pivoting lever 184 belonging to the pressure device 170 and holding the latter in its lifted position.

At its lower end 186, facing away from the top end 182, the actuating lever 174 has a pin 188 on which a driver lever 190 can act, said driver lever being connected to the control shaft 60 so as to rotate with it and, according to FIG. 10, in the event of rotation of the control shaft 60 in the counterclockwise direction, striking the pin 188 and, in so doing, pulling the actuating lever 174 obliquely downward counter to the stress of the spring 180. As a result, the pressure device 170 is also lowered, so that it can press a printing medium lying on the lower covering 32 against the reading/writing device 168.

FIGS. 10 and 11 also show a reading device, generally designated by 192, for reading characters written with magnetizable ink on a printing medium. The reading device 192 comprises, in a manner known per se, a magnetization head 194 and a reading head 196. The magnetization head 194 has the task of magnetizing the characters printed with magnetizable ink on the printing medium so that they can be read by the reading head 196. This reading head 196 is in turn assigned a pressure device 198 in order to press the printing medium against the reading head 196 when the characters are to be read. This pressing device 198 has a swinging arm 200 which is mounted on the outer frame 14 such that it can be pivoted about an axis 202 in a manner not illustrated, and bears a pressure roller 204. The swinging arm 200 is biased into its position illustrated in FIG. 10, in which the pressure roller 204 is lifted off the reading head 196, by a helical compression spring 206, which is supported at one end on a section (not illustrated) fixed to the frame and at the other end on an end of the swinging arm 200 that faces away from the pressure roller 204.

In order to adjust the swinging arm 200 into its pressure position illustrated in FIG. 11, use is made of a pressure lever 208, which is mounted such that it can be pivoted about an axis 210 and presses onto the swinging arm 200 with its one lever arm 212, while its other lever arm 214 is connected via a hinge 216 to the one end of an actuating lever 218. The latter is mounted on the outside of the side wall 20 of the frame 18 such that it can be displaced translationally in the direction of the double arrow C in FIG. 11. Its end facing away from the hinge 216 rests on a cam disc 220 of the control shaft 60, with the aid of which the swinging arm 200 can be pivoted, via the linkage 218, 208, between the positions illustrated in FIGS. 10 and 11.

As the above description shows, the pressure rollers 54 interacting with the transport rollers 38, the receipt stop 122, the printing bar 30, the foil carrier 98 with the foil strips 100, the coupling sleeve 142 of the alignment device, the pressure device 170 for the magnetic-strip reading and writing device 168, and the pressure device 198 for the reading device 192 can all be adjusted by means of the control shaft 60. The essential factor here is that the cams are arranged on the control shaft 60 in such a way that the functions of the above-described parts of the printer do not hamper one another.

FIG. 12 shows the functional sequences of the above-described devices as a function of the rotational angle and of the direction of rotation of the control shaft 60.

The control shaft 60 can be pivoted about a normalization position, which is assigned to the angle 0 up to −73° in one direction of rotation and up to +266° in the other direction of rotation. These limits of the pivoting range of the control shaft 60 are defined by a switching flag 222 on the control shaft 60 (FIGS. 3 and 4), which engages in a forked light barrier (not illustrated).

The first line of FIG. 12 shows the switching range of the forked light barrier. The hatched region to the left of the zero line indicates the region in which the forked light barrier outputs the signal "light", that is to say in which it is not interrupted by the switching flag 222. The region lying to the right of the zero line indicates the angular range of the control shaft 60 in which the switching flag 222 interrupts to beam in the forked light barrier, so that the latter outputs its signal "dark".

The second line of FIG. 12 relates to the function of the receipt stop 122. Between −73° and −65° the receipt stop is located in its upper position (hatched region). In this position, the receipt stop blocks the insertion of a printing medium over the printing bar 30. Between −65° and +52°, the receipt stop is lowered continuously. Once the receipt stop has been lowered completely, the printing medium can be moved as desired in the printer.

The third line relates to the pressure rollers 54 interacting with the transport rollers 38. Between −73° and −65°, the pressure rollers assume their upper position (hatched region). Between −65° and 0°, the pressure rollers are lowered together with the receipt stop until they rest on the transport rollers 38. Between 0° and 266°, a printing medium can be gripped and transported by the transport rollers 38.

The fourth line of FIG. 12 relates to the alignment device. In the hatched region, the alignment device is switched on, that is to say the alignment rollers 148 and 154 are rotated in order to align the printing medium against the receipt stop 122. Lines 2, 3 and 4 therefore relate to measures which are used to prepare a print.

Line 5 shows the regions in which the printing bar is lifted and lowered (hatched region from −73° to +155°) and in which the printing bar is completely lowered (+155° to 266°). The sixth line, which reproduces the positions of the pressure film, corresponds to this region. As long as the printing bar 30 is in its upper position, in which printing can also be carried out, the pressure film is in its lower position, in which it presses the printing medium against the printing bar 30. This region extends from −73° to +155°. On the other hand, when the printing bar 30 is lowered completely, the pressure film 100 is lifted (hatched region from +155° to 266°). When the printing bar 30 is lowered and the pressure film 100 is lifted, printing media can be moved through between the printing bar and the pressure film.

The seventh line reproduces the position of the pressure device 198 associated with the reading device 192. The hatched region from −73° to +210° corresponds to the lifted position and the transition of the pressure device 198 into its pressure position. The non-hatched region from 210° to 266° corresponds to the pressure position of the pressure device 198, in which the magnetized characters on the printing medium can be read.

The eighth line relates to the position of the pressure device 170 of the magnetic strip reading/writing device. In the hatched region from −73° to +262°, the pressure device 170 is in its lifted state and changes into the lowered state. Only in the narrow region between 262° and 266° of the control shaft 60 does the pressure device 170 rest on the magnetic head of the reading/writing device 168.

If a printing medium is inserted into the printer, then the receipt stop 122 is initially located in its upper position. The printing medium is aligned against the receipt stop 122 with the aid of the alignment device 133. The control shaft 60 is then rotated until the receipt stop 122 is lowered, the alignment device 133 is switched off and the pressure rollers 54 can engage with the transport rollers 38.

In order to insert the printing medium between the printing bar 30 and the pressure film 100, first of all the printing bar 30 has to be lowered and the pressure film 100 lifted. This means that the control shaft 60 has first of all to be rotated onward to 205°. In this position of the printing bar 30 and of the pressure film 100, the printing medium can be moved freely within the printer, so that it can also be brought into a position suitable for the reading device 192 or the reading/writing device 168. The pressure devices 198 and 170, which correspond to these reading devices can be operated without the printing bar 30 having to be adjusted first for this purpose, or without the transport of the printing medium in the printer being hampered.

For the purpose of printing, the printing medium then has to be brought first into a position suitable for printing, between the printing bar 30 and the printing head 24. Then, by means of a rotation of the control shaft 60 into the 90° position, the printing bar 30 is lifted and the pressure film 100 is lowered, whereupon a print can then be made.

List of reference symbols

| | | | |
|---|---|---|---|
| 10 | Chassis | 78 | Helical compression spring |
| 12 | Base | 80 | Pin |
| 14 | Outer frame | 82 | Actuating lever |
| 16 | Frame wall | 84 | Pivot axis |
| 18 | Inner frame | 86 | Lever arm (forked arm) |
| 20 | Side wall | 88 | Lug |
| 22 | Guide rod | 90 | Lever arm |
| 24 | Dot-matrix printing head | 92 | Free end |
| 26 | Carriage | 94 | Cam discs |
| 28 | Toothed belt | 96 | Pressure device |
| 30 | Printing bar | 98 | Film carrier |
| 32 | Lower covering | 100 | Film strip |
| 34 | Transport shaft | 102 | Clip |
| 36 | Transport shaft | 104 | Axis |
| 38 | Transport rollers | 106 | Lever |
| 40 | Drive roller | 108 | Helical compression spring |
| 42 | Drive roller | 110 | Extension |
| 44 | Drive motor | 112 | First lever arm |
| 46 | Shaft | 114 | Actuating lever |
| 48 | Drive pinion | 116 | Axis |
| 50 | Drive belt | 118 | Second lever arm |
| 52 | Tensioning roller | 120 | Cam disc |
| 54 | Pressure roller | 122 | Receipt stop |
| 56 | Carrier | 124 | Carrier |
| 58 | Transverse strut | 126 | Stop elements |
| 60 | Control shaft | 128 | Stop elements |
| 62 | Gear wheel | 130 | Extension |
| 64 | Toothed belt | 132 | Cam disc |
| 66 | Drive pinion | 133 | Alignment device |
| 68 | Motor | 134 | Bearing block |
| 70 | Carrier | 136 | Shaft |
| 72 | Top rail | 138 | First coupling sleeve |
| 74 | Top side | 140 | Drive belt |
| 76 | Guide nose | 142 | Second coupling sleeve |
| 144 | Coupling claws | 212 | Lever arm |

-continued

| List of reference symbols | | | |
|---|---|---|---|
| 146 | Coupling claws | 214 | Lever arm |
| 148 | Alignment roller | 216 | Hinge |
| 150 | Bevel gear wheel | 218 | Actuating lever |
| 152 | Bevel gear wheel | 220 | Cam disc |
| 154 | Alignment roller | 222 | Switching flag |
| 155 | Axis | | |
| 156 | Coupling lever | | |
| 158 | Axis | | |
| 160 | First lever arm | | |
| 162 | Helical spring | | |
| 164 | Second lever arm | | |
| 166 | Axial cam disc | | |
| 168 | Reading/writing device | | |
| 170 | Pressure device | | |
| 172 | Compression spring | | |
| 174 | Actuating lever | | |
| 176 | Pin | | |
| 178 | Slot | | |
| 180 | Compression spring | | |
| 182 | Top end | | |
| 184 | Pivoting lever | | |
| 186 | Lower end | | |
| 188 | Pin | | |
| 190 | Driver lever | | |
| 192 | Reading device | | |
| 194 | Magnetization head | | |
| 196 | Reading head | | |
| 198 | Pressure device | | |
| 200 | Swinging arm | | |
| 202 | Shaft | | |
| 204 | Pressure roller | | |
| 206 | Helical compression spring | | |
| 208 | Pressure lever | | |
| 210 | Shaft | | |

What is claimed is:

1. A printer for printing on a printing medium, said printer comprising a printer frame, a transport device for moving a printing medium along a transport path in a transport direction relative to the printer frame, a printing head, which printing head is adjustably guided transversely with respect to the transport direction of the printing medium on a printing head guide, a printing head drive, a printing bar assigned to the printing head, a printing medium stop which can be adjusted between a blocking position, in which it projects into the transport path of the printing medium, and a release position, means for aligning the printing medium relative to the printer frame both in said transport direction and in a direction transverse to the transport direction while the printing medium stop is in the blocking position, and a printing control system, wherein a control shaft is rotatably mounted in the printer frame, is driven by a motor controlled by a printer control system, and bears a plurality of control cams, of which cams respectively at least one controls the activation of the transport device, at least one controls the activation of the alignment means, and at least one controls the adjustment of the printing medium stop, control curves of the control cams being designed such that an activation zone of the alignment means and an activation zone of the printing medium stop are located substantially in a deactivation zone of the transport device.

2. The printer as claimed in claim 1, wherein the transport device comprises at least one driven transport shaft having transport rollers, and pressure rollers which are associated with the transport rollers, the pressure rollers being adjustable between a pressure position close to the transport rollers and a rest position away from the transport rollers.

3. The printer as claimed in claim 1, wherein the printing bar can be adjusted in relation to the printing head, by a control cam on the control shaft, between a printing position close to said printing head and a rest position away from the latter, and in that the control curve of the printing bar control cam is designed such that the rest position of the printing bar is located in the activation zone of the transport device.

4. The printer as claimed in claim 3, wherein an angular range of the control curve of the printing-bar control cam which corresponds to the printing position of the printing bar extends over the deactivation zone and an adjacent part of the activation zone of the transport device.

5. The printer as claimed in claim 3, wherein in that parallel to the printing bar there is arranged a pressure-film strip on a film carrier, which film carrier is adjustable between a position close to the printing bar and a position away from the printing bar, and in that the adjustment of the film carrier is controlled by a film carrier control cam on the control shaft a control curve of which cam is designed such that when the printing bar is located in the printing position the film carrier is located close to the printing bar, and when the film carrier is in the rest position the film carrier is located away from the printing bar.

6. The printer as claimed in claim 3, wherein the printer has a reading device for reading characters printed with magnetic ink on the printing medium, and the reading device has at least one magnetic head and a printing medium pressure device, which printing medium pressure device is activated by a control cam on the control shaft, a control curve of which control cam being designed such that the activation zone of the printing medium pressure device is located in a zone corresponding to the rest position of the printing bar.

7. The printer as claimed in claim 3, wherein the printer has a reading/writing device for reading and writing on a magnetic strip on the printing medium, and in that the reading/writing device has a magnetic head arrangement and a printing medium pressure device, which can be activated by a control cam on the control shaft, a control curve of this control cam being designed such that the activation zone of the printing medium pressure device is located within the activation zone of the printing medium pressure device.

8. The printer as claimed in claim 1, wherein the control shaft has a switching flag which defines a start position and an end position and an end position of the control shaft, between which start and end positions the control shaft can be rotated to and fro.

* * * * *